US009339717B2

(12) United States Patent
Korich

(10) Patent No.: US 9,339,717 B2
(45) Date of Patent: May 17, 2016

(54) APPARATUS FOR ALTERING THE RAMP ANGLE OF A SKI BINDING AND METHOD FOR OPTIMIZING THE (FORE-AFT) BALANCE OF A SKIER

(71) Applicant: Chris Korich, Oakland, CA (US)

(72) Inventor: Chris Korich, Oakland, CA (US)

(73) Assignee: Biostance LLC, Vail, CO (US)

( * ) Notice: Subject to any disclaimer, the term of this patent is extended or adjusted under 35 U.S.C. 154(b) by 0 days.

(21) Appl. No.: 13/852,976

(22) Filed: Mar. 28, 2013

(65) Prior Publication Data

US 2014/0091555 A1 Apr. 3, 2014

Related U.S. Application Data

(60) Provisional application No. 61/617,328, filed on Mar. 29, 2012.

(51) Int. Cl.

| | |
|---|---|
| ***A63C 9/00*** | (2012.01) |
| *A63C 7/10* | (2006.01) |
| *B30B 15/30* | (2006.01) |
| *A63C 9/085* | (2012.01) |

(52) U.S. Cl.

CPC . *A63C 9/00* (2013.01); *A63C 9/005* (2013.01); *A63C 7/1013* (2013.01); *A63C 9/001* (2013.01); *A63C 9/003* (2013.01); *A63C 9/085* (2013.01); *B30B 15/308* (2013.01)

(58) Field of Classification Search

CPC ..... A63C 9/00; A63C 9/005; A63C 9/085; A63C 7/1013; A63C 9/001; A63C 9/003; B30B 15/308

See application file for complete search history.

(56) References Cited

U.S. PATENT DOCUMENTS

2012/0061945 A1* 3/2012 Korich ..... 280/617

* cited by examiner

*Primary Examiner* — S. Joseph Morano
*Assistant Examiner* — Hilary L Johns
(74) *Attorney, Agent, or Firm* — Charles E. Krueger

(57) ABSTRACT

An apparatus and method for balancing a skier comprising a ramp angle toe on the toe bearing surface of a ski binding. The ramp angle plate has positions of varying heights for inducing a ramp angle when the toe of a boot rests on the ramp angle plate on the toe bearing surface of the binding. Thus, the ramp angle plate alters the ramp angle at which a boot supports a skier's foot and lower leg, relative to the longitudinal running surface or bottom plane of an attached ski. An apparatus that allows a skier to adjust the ramp angle on the slope without stepping out of the binding.

2 Claims, 17 Drawing Sheets

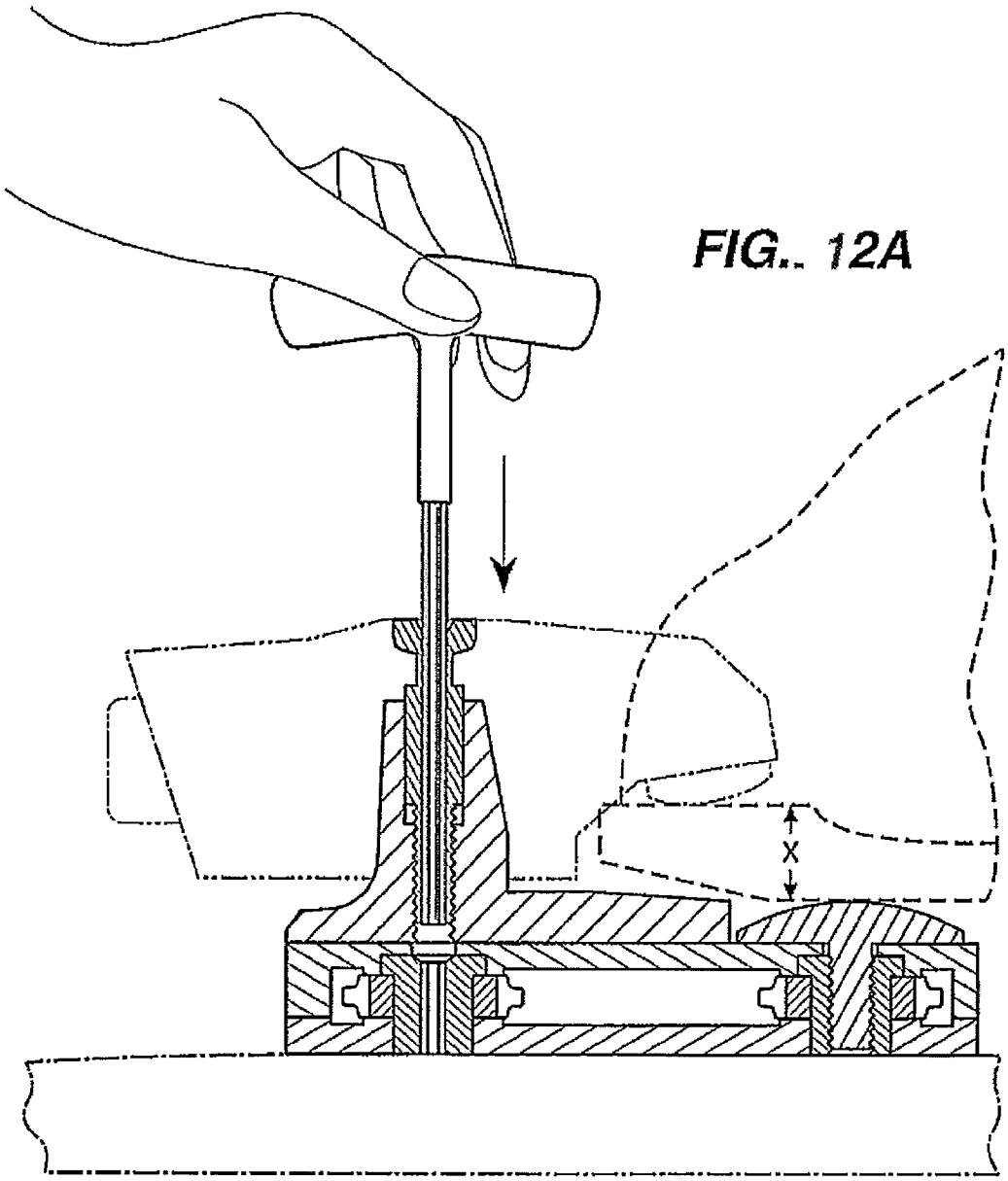
FIG.. 12A

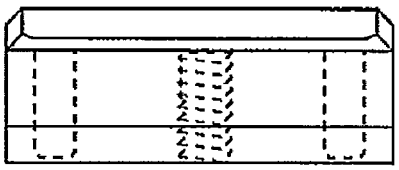
FIG._13B
FIG._13A
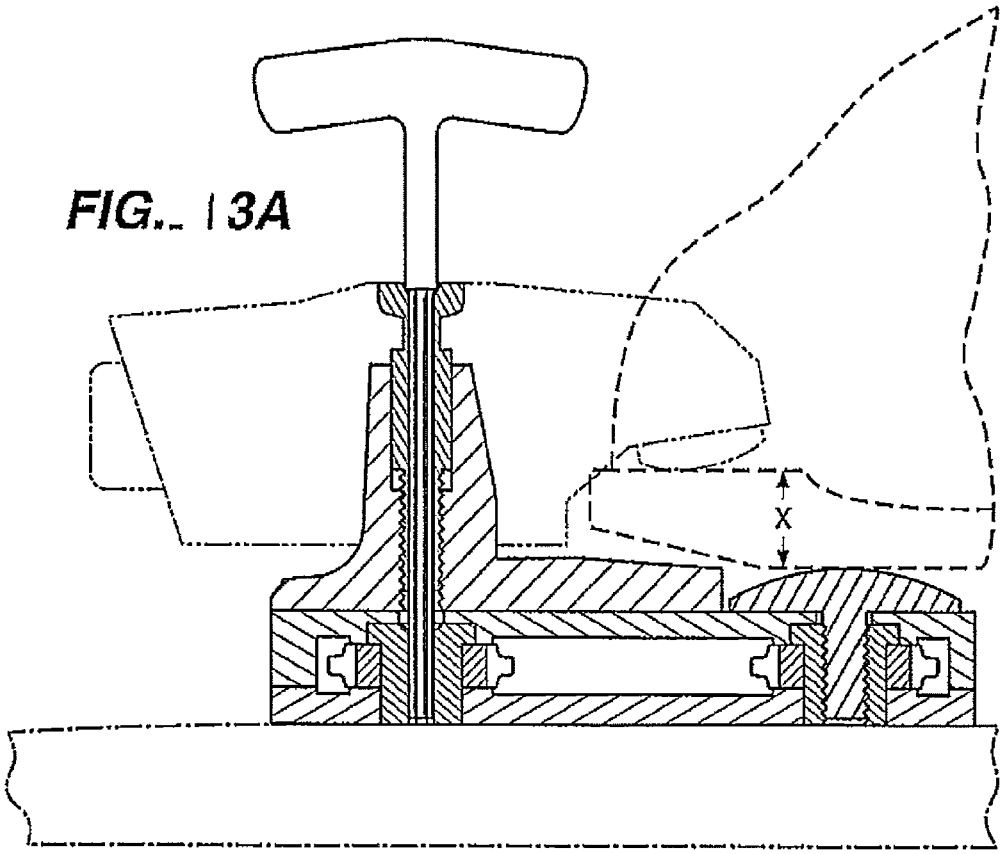

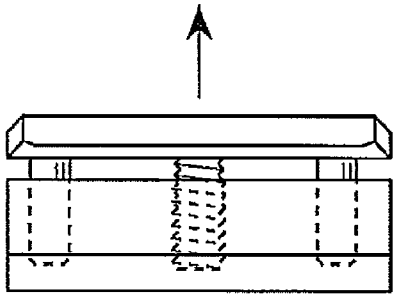
FIG.. 14B
FIG._ 14A
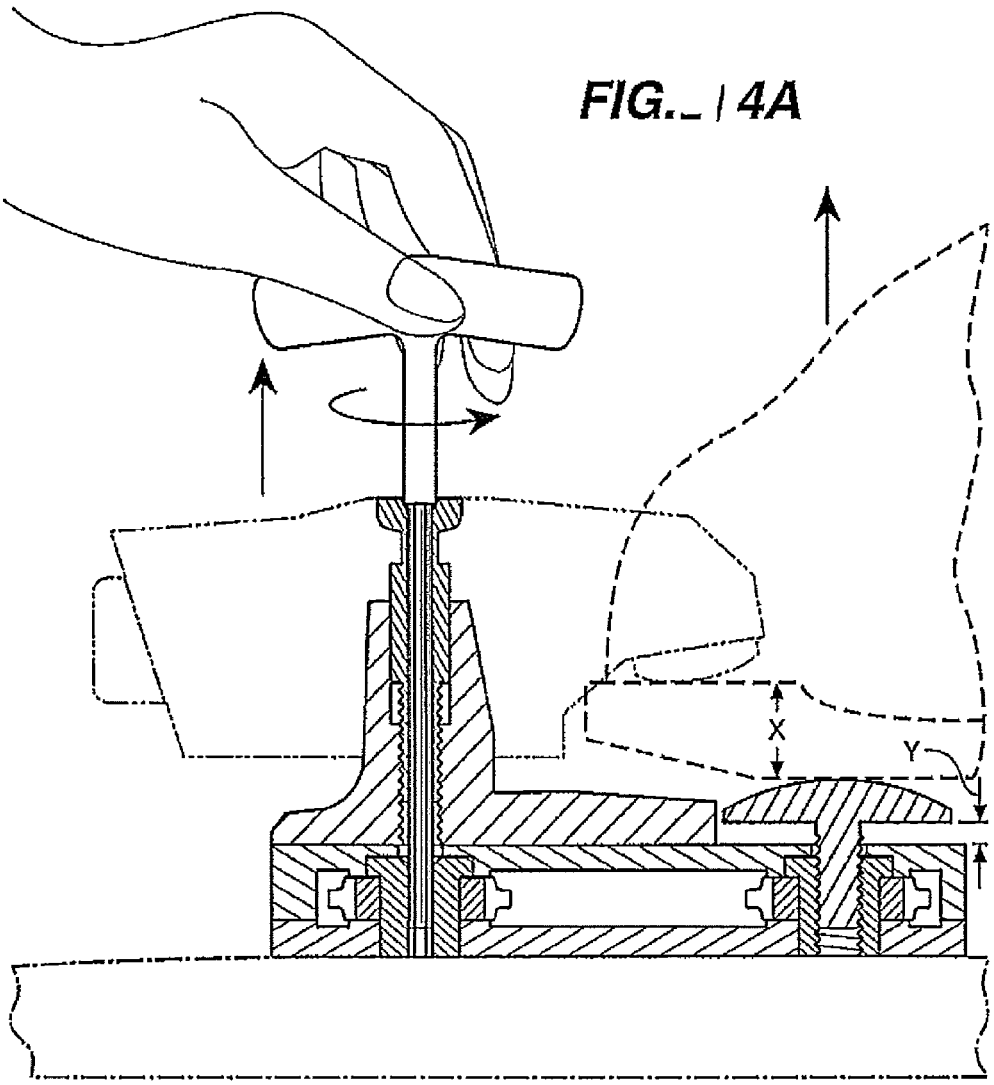

APPARATUS FOR ALTERING THE RAMP ANGLE OF A SKI BINDING AND METHOD FOR OPTIMIZING THE (FORE-AFT) BALANCE OF A SKIER

RELATED APPLICATIONS

This application claims priority from a provisional application filed Mar. 29, 2012 entitled APPARATUS FOR ALTERING THE RAMP ANGLE OF A SKI BINDING AND METHOD FOR OPTIMIZING THE (FORE-AFT) BALANCE OF A SKIER, Application No. 61/617,328 which is hereby incorporated by reference for all purposes.

BACKGROUND OF THE INVENTION

To maximize skiing enjoyment, proficiency and safety, all skiers need their equipment anatomically adjusted. One of the most critical anatomical adjustments is referred to as "fore-aft balancing", "lean angle", "ramp angle" or "relative height of heel to height of toe" of the bottom of the boot when is is secured in the binding in a skiing position.

Fore-aft balancing alters the fore-aft tilt or "lean angle" at which a boot supports a skier's foot and lower leg, relative to the longitudinal running surface or bottom plane of an attached ski. Optimizing the lean angle improves skeletal alignment and allows the skier to stay balanced or to regain balance while tilting or "edging" the ski with the least amount of muscular effort.

In the 1993 book "The Athletic Skier", authors Warren Witherell and David Evrard wrote that, "Only when properly balanced over the ski can our bodies and skis work as efficiently as possible." Fore-aft balancing is the most important step in the alignment process that makes efficient and balanced skiing possible for all skiers.

Skiing is a sport of balance. The skier must keep his center of mass balanced over the skis so that the skis can be controlled by the skier to bend and flex and allow the skier to maneuver down a hill. Skiers are continually trying to achieve optimal efficiency through proper skeletal alignment. This is so that muscle energy is not wasted in maintaining proper balance but, rather, is available to be employed for maneuvering down a hill.

In skiing, the skier employs boots and skis interconnected together by bindings. The ski/boot/binding system may be thought of as a bracing system that acts as an extension of the skier's feet.

In known ski boots, the heel of the skier is by design higher in elevation than the ball of the skier's foot when the boot sole is on a level surface. This provides a "normal" feeling of comfort when standing and walking.

This initial heel height inside the boot configuration causes the feet of the skier, when placed in such boots, to adopt an angular relationship with respect to a ground surface characterized by the heels of the user being elevated with respect to the balls of the user's feet.

Skis have a bottom surface designed to engage and glide over snow and ice and a top surface supporting the skier in a binding. The fore region of a ski at the toe area of the binding is not necessarily equal in height above the bottom surface of the ski to the aft region at the heel area of the binding thereof and, thus, the top surface of a ski may angle from a higher or lower elevation at the front to a lower or higher elevation at the rear with respect to the bottom surface of the ski or it may be level. Accordingly, in some situations, the angle of the top surface of the ski may increase the severity of the lean angle of the ski boot and in some situations it may lessen the lean angle.

Bindings are designed for two main purposes but also affect the lean angle of the skier. First, ski bindings provide the manually activated attachment and detachment of a ski boot to a ski. Second, for safety bindings are designed with a release mechanism allowing the ski boot to be released from the ski when forces from particular directions above a design threshold are achieved. This second purpose helps to prevent injuries to the skier. Typically, a binding includes two separate portions, a heel support portion and a toe support portion. With most but not all commercially available bindings, the heel support portion supports the heel at a higher elevation than the toe support portion supports the toe. Thus, most bindings increase the lean angle of the boots although the amount of lean angle varies from binding model to binding model.

Now it is understood that the fore-aft balance or lean angle of a skier should provide for equal weighting of the ball of the foot and the heel of the foot under most conditions such as when skiing on a level surface. This is critical to the performance, comfort, endurance and safety of the skier. Further, due to anatomical differences, skiing styles and other factors, each skier has a unique lean angle that is optimal for that skier.

World Cup skiers and other racing professionals have their lean angle finely adjusted on all of their ski/binding systems to their personal prescription for a particular pair of ski boots to achieve this optimal result but the recreational skier does not have access to such expertise and in only a small percentage of the cases, is the boot, ski and binding resultant lean angle optimal for the individual. It has been the experience of the inventor from over thirty years of balancing skiers that less than 15% of the recreational skiers are at this optimal angle.

It can be further seen that a change in bindings could result in very large changes in lean angle. For example, for the 2011-2012 season the Marker Baron (265-320 mm boot sole) has the heel 0.60 mm higher than the toe while for the 2011-2012 season the Head Mojo 7.5 (white/black) binding has the heel 9.00 mm higher than the toe. For this same 2011-2012 season the Rossignol SAS 110 Wide White binding was measured at 10.00 mm and the Atomic Neox SF 614 VIP binding having the TOE 0.75 mm HIGHER than the heel!

Adding to the complexity of achieving an optimal lean angle is that for boots of differing lengths, the two separate heel and toe binding portions are mounted on the ski at differing distances from one another. Thus, different spacing between the heel support portion and toe support portion of the binding result in a different lean angle for each boot length.

As should now be understood, when one takes into account the various fore-aft lean angles created by the structures of the boot, ski, and binding, even skiers using the same model ski, the same model binding and the same model boot but with differing boot sizes will stand over their respective skis with differing net lean angles.

Thus, a need has developed for a method and apparatus that may be employed, universally, to allow a skier to adopt a fore-aft lean angle that is optimal for the skier's skill level, comfort, and safety. A further need is for this lean angle adjustment to be possible to change on the slope during skiing and ideally without stepping out of the binding.

Unfortunately most ski shops still do not offer balancing services and only a small percentage of skiers know that bindings have different lean angles, therefore, only a small percentage of skiers ever have their lean angle tested or altered. Further no binding system is currently available that allows lean angle adjustment on the slope much less without stepping out of the binding. There are numerous reasons for this which will become apparent in the review of prior art.

DESCRIPTION OF PRIOR ART

Field of the Invention

The present invention relates to a system for the positioning of skier on skis that can customize the lean angle position of a skier relative to a ski.

BACKGROUND OF THE INVENTION

Snow skiing is a sport in which the participant navigates down a snow covered hill by wearing boots that are attached to skis by bindings. People naturally have different stances as a result of their anatomy. Consequently it is beneficial to performance, safety, and comfort to allow the user to separately customize their fore-aft balance on the ski (hereinafter called "ramp angle").

Pitch is defined as the height of the front relative to the rear of the boot. Because people's legs vary in length and flexibility, an individual's preference for pitch varies. Currently, boot pitch is determined by the boot manufacturer and can be customized to a limited degree by internal adjustments under the foot and/or by grinding the sole of the boot. Another method for altering pitch is disclosed by DeRocco et al. in U.S. Pat. No. 5,884,934. DeRocco et al disclose a ski having a binding mounting portion for angling the pitch orientation only of a boot relative to a ski.

Roll, also called cant, is defined as the height of the inner relative to the outer edge of the boot. Patent application Pub. No.: US 2007/0108734 A1 by Korich describes a novel apparatus and method for adjusting cant.

Height is defined as the distance from the base (bottom) of the boot to the base (bottom) of the ski. People's legs can differ in length, shape, etc., which means that the weight distribution between their feet can be unequal. Commercially available "plates" can raise the skier significantly off the snow. However, current art is not designed to equalize weighting between the feet. Grinding the base of the boot can create limited variation. U.S. Pat. No. 5,090,139 by Germann discloses a ski boot with a height-adjustable foot-bed.

Germann's disclosure applies only to the modification of a ski boot and not of a ski. Germann teaches a ski boot with a height-adjustable foot bed wherein the foot bed adjustment may be made when fitting the foot to the boot but not thereafter.

The ability to deal with ramp angle is important to a skier's performance, safety, and comfort. A need exists for a mechanism to allow alteration of the ramp angle, either separately or simultaneously with other parameters, which does not require modification of the specific boot of a user.

In the prior art, it is known to provide boots with internal adjustment means that allow adjustment of the fore-aft ramp angle between the heel support and the support for the ball of the foot thereof. Typically, such adjusting means are adjusted when the skier is being fitted to the boot to optimize the snugness and comfort of the interconnection between the foot and the boot and is done with the bottom of the boot toe and heel at the same height i.e., the floor of the ski shop. Once such adjustments are made, the fore-aft lean angle within the boot is set. One cannot later change this ramp angle without affecting the fit of the boot nor can the boot be changed from ski to ski for skis with different ramp angles.

In U.S. Pat. No. 6,715,782 by Sosin, et al a method and apparatus is disclosed that allows a user to individually or simultaneously customize the pitch, roll, height, yaw, linear placement and lateral placement of his/her boots on his/her skis. This system allows the user to stand in a position while skiing that is closer to his/her natural position and to have the parameters of such a stance measured and quantified, thereby improving comfort, performance, and safety. As opposed to the limited variation in only some parameters described by current art, this invention allows significant variation in all individual parameters and simultaneous customization of all parameters. This invention has not been commercialized due to the cost and complexity involved.

The following additional prior art is known to Applicant:

U.S. Pat. No. 4,945,659 to DeMarchi et al. discloses a ski boot having an interchangeable sole portion for controlling global wedging angle of boot. The present invention differs from the teachings of DeMarchi et al. because once the separate sole portion has been chosen and the skier is wearing the boot and attached to the ski via the binding, it is not possible to change the fore-aft ramp angle.

U.S. Pat. No. 5,348,335 to Dasarmaux et al. discloses a device for adjustment of the longitudinal position of an alpine binding. Such a device is commonly employed on skis that are rented and permits adjustment of the spacing between the heel support binding and the toe support binding to accommodate to ski boots of differing lengths. The adjustment for different boot lengths unintentionally changes ramp angle but does not allow for improving the balance of the skier.

U.S. Pat. No. 5,474,321 to Pritz discloses a carrying plate for securing a ski boot on a ski. Pritz fails to teach or suggest adjustment of the fore-aft ramp angle.

U.S. Pat. No. 5,501,483 to Stepanek et al. describes a ski binding toe unit design that includes an "automatic gap adjustment" feature that is described in more detail below. My present invention, in alternate embodiments thereof, contemplates an improvement that includes structure or parts incorporated into a ski binding such as that disclosed by Stepanek et al. Stepanek et al. fail to disclose any means for adjusting the fore-aft ramp angle of a skier.

U.S. Pat. No. 5,538,271 to Abondance discloses a plate for mounting a boot binding on an alpine ski that reduces the rigidity of the ski in the area where the boot is mounted. Abondance fails to teach or suggest any means for adjusting the fore-aft ramp angle of the skier.

U.S. Pat. Nos. 5,538,356 and 5,560,634 to Challande et al. describes a ski binding toe unit design that includes a "manual gap adjustment" feature that is described in more detail below. My present invention, in several embodiments thereof, contemplates an improvement that includes structure or parts incorporated into a ski binding such as that disclosed by Challande et al. Challande et al. fail to disclose any means for adjusting the fore-aft ramp angle of a skier.

U.S. Pat. No. 5,575,496 to Luitz et al. discloses a binding unit between a boot and an item of sports equipment that includes an adjusting device manipulated by the end of a ski pole to allow adjustments of the binding unit in the longitudinal direction. Luitz et al. fail to teach or suggest any means allowing adjustment of the fore-aft ramp angle of the skier.

There is also a segment of the retail market that sells integrated ski-binding systems to skiers. On many of these systems, the binding is not attached to the ski with screws, but by various other means such as sliding the binding onto rails or tracks integrated into the ski construction. In these cases, a prior art method of installing ramp angle wedges or shims is not feasible.

Due to airline baggage fees and personal preferences an increasing number of skiers choose to rent skis, and/or "demo" various retail models before they buy. Due to the time, labor and cost of installing ramp angle wedges, ramp angle rentals are not available, yet they are critical to the performance of the ski/binding/boot system. As most first time skiers rent, this is one of the reasons that currently only 16% of the first time US skiers ever ski again.

Due to the above problems and limitations on installing ramp angle wedges, a small percentage of ski shops and skiers prefer to permanently grind or plane the bottom toe and heel sole portions of the boot. This method is known as "sole planing". Unfortunately, sole planing is often an imprecise operation when done by ski shop employees and requires the use of potentially dangerous machinery. Because it is irreversible, a mistake can ruin an expensive pair of boots. It requires that the boot toe and heel sole portions be built back up to meet International Standard ISO 5355 for boot sole thickness and shape dimensions. Even if a sole planning is done for one ski/binding combination, it will be wrong for other ski's binding combinations. As has been demonstrated, heel toe height can vary by as much as 10 mm from one ski/binding to another.

OBJECTS AND ADVANTAGES

Accordingly, a need exists for a simple ramp angle solution to overcome all of the problems of the prior art above. Several objects and advantages of the present invention are:

(a) to provide an apparatus and method for balancing a skier that is fast and efficient, that doesn't require the custom mounting or remounting of each pair of skis by a skilled technician, or have the potential for damaging the ski, or cause the binding screws to pull out which could lead to potential injury, nor the need to stock a multitude of screw styles in various lengths to meet International ISO Standards;

(b) to provide an apparatus and method for balancing a skier that allows the left and right skis and any balancing to be changed out on the hill as desired;

In at least one embodiment, to provide that the adjustment of ramp angle may be done "on the slope" without stepping out of the binding;

(c) to provide an apparatus and method for balancing a skier on integrated ski-binding systems;

(d) to provide an apparatus and method for balancing a skier on rental or "demo" skis, both quickly and cost effectively, to enhance the skier's experience and increase the desire to continue in the sport;

(e) to provide an apparatus and method for balancing a skier that is accurate and reversible, and that does not require dangerous grinding or planing of the bottom toe and heel sole portions of the boot, nor any building up of these sole portions to meet any International ISO Standards;

(f) to provide an apparatus and method for balancing a skier that can be used with any boot and produced cost effectively in ramp angle increments finer than one-twentieth of one degree; and (g) to provide an apparatus and method for balancing a skier that is practical, lightweight, inexpensive, and widely available.

Still further objects and advantages are to provide an apparatus and method for balancing a skier that only has to include a modification under the toe support portion of a boot or binding, that is designed to induce a prescribed ramp angle prescribed for a particular skier, that can be designed compatible with the majority of skis on the market, and manufactured cost effectively out of well-known materials, in various colors, and with visible labeling in a desired location to identify the ramp angle. Still further objects and advantages will become apparent from a consideration of the ensuing description and drawings.

BRIEF DESCRIPTION OF THE DRAWINGS

FIGS. 12 and 12A depict a cross-sectional view of a replacement toe embodiment of the invention with on slope adjustment;

FIG. 13A shows an adjustment tool fully inserted;

FIG. 13B shows a sectional end view of boot support 138 (see FIGS. 8 and 11) at its lowest position;

FIG. 14A depicts an adjustment tool being turned in a counterclockwise direction;

FIG. 14B shows a sectional end view of boot support 138 in an elevated position;

FIGS. 19A-B depict an alternative embodiment of the invention where the toe is raised by sliding an angled shim under the AFD thereby raising the toe by tilting it up.

DETAILED DESCRIPTION OF THE INVENTION

Reference will now be made in detail to various embodiments of the invention. Examples of these embodiments are illustrated in the accompanying drawings. While the invention will be described in conjunction with these embodiments, it will be understood that it is not intended to limit the invention to any embodiment. On the contrary, it is intended to cover alternatives, modifications, and equivalents as may be included within the spirit and scope of the invention as defined by the appended claims. In the following description, numerous specific details are set forth in order to provide a thorough understanding of the various embodiments. However, the present invention may be practiced without some or all of these specific details. In other instances, well known process operations have not been described in detail in order to not unnecessarily obscure the present invention.

The inventor has discovered through analysis of current ski binding function, the biomechanics of skiing, and extensive experimental testing of hundreds of skiers, that a skier can be effectively balanced in the fore-aft direction by making modifications under only the toe support portion of a boot or binding. This has allowed the design of a novel system of balancing that eliminates all of the problems listed above for actual and proposed balancing systems. In the following, various embodiments of an apparatus and method for balancing a skier are described that are extremely effective in altering the ramp angle at which a boot supports a skier's foot and lower leg, relative to the longitudinal running surface or bottom plane of an attached ski. Optimizing the ramp angle improves skeletal alignment and allows the skier to tilt or "edge" the ski with the least amount of muscular effort.

Figure 1A:
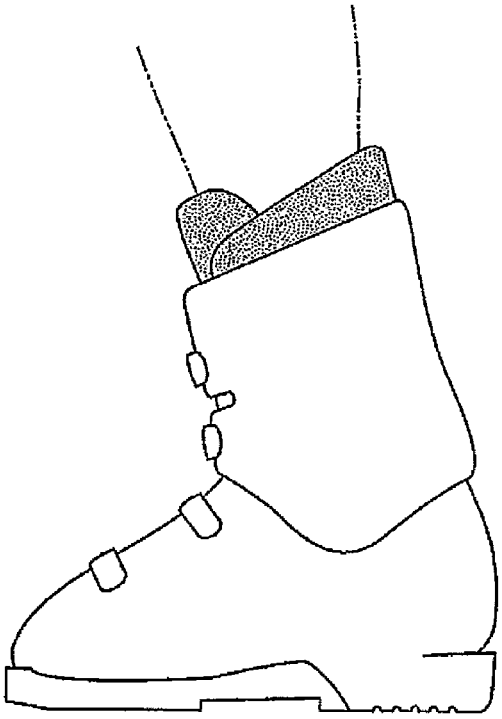
FIGS. 1A-1C and 2 depict views of a conventional ski binding system, ski boot, heel and toe binding units, and ski portion.
Figure 1B:
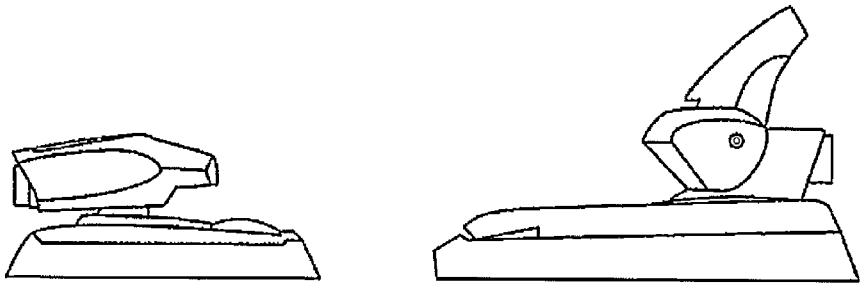
Figure 1C:
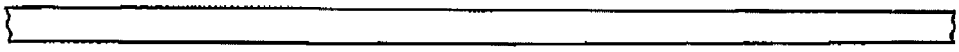
Figure 2:
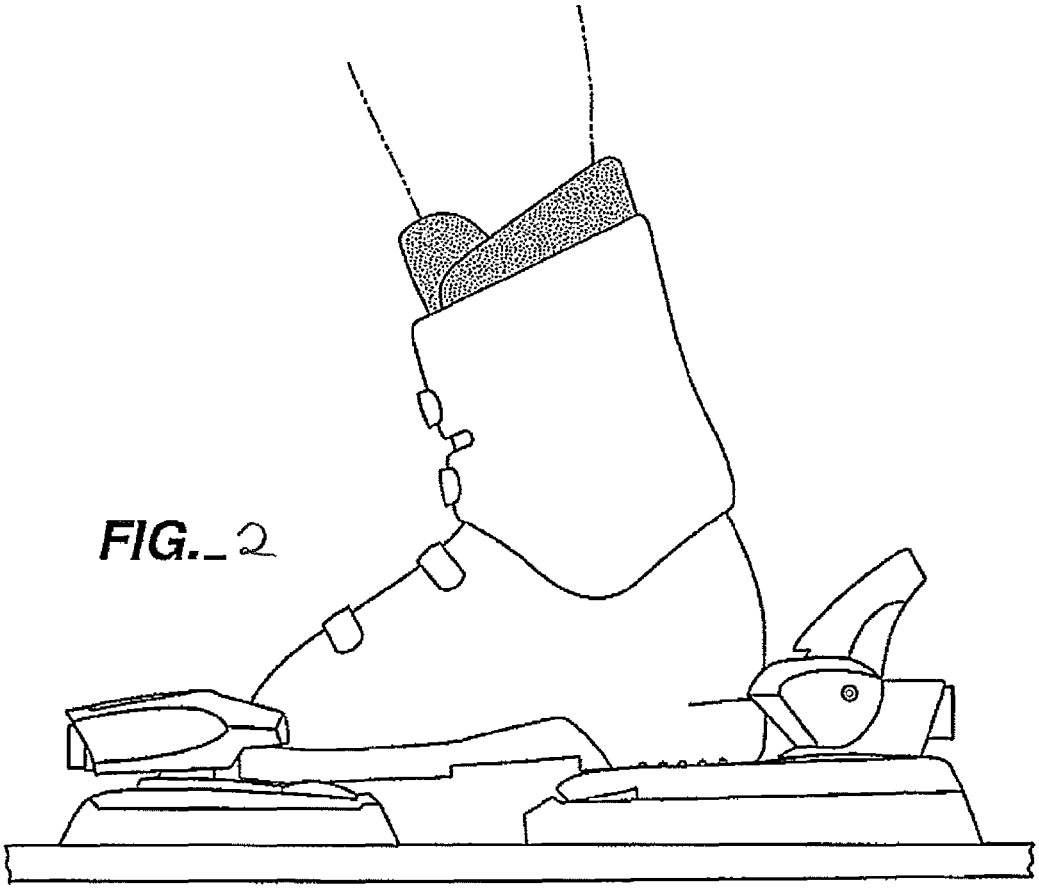

Referring now to the drawings in which like numerals are used throughout the several views to indicate like or corresponding parts, FIGS. 1A-C and FIG. 2 depict a skier with a boot binding ski system. FIGS. 1A-C show the ski boot, a binding with separated heel and toe units and the section of ski the binding is mounted on with screws. In FIG. 1C, a portion of a ski is depicted having a running surface, which contacts the snow when skiing, and an upper surface on which a binding is mounted. Bindings come in many designs; however FIGS. 1A-C depict depicts generic components which are included in most bindings. A detailed description of the function of the components will be provided below.

The binding includes a toe unit, a heel unit, and an integrated brake system.

FIG. 1A also depicts a generic ski boot having an outer shell including an upper cuff for supporting the skier's lower leg and a lower shell for supporting the skier's foot. The boot also includes a sole having a boot toe portion that is engaged by the toe unit of the binding and a boot heel portion that is engaged by the heel unit of the binding.

DETAILED DESCRIPTION OF THE INVENTION (FIGS. 3 THROUGH 11)

Figure 3A:
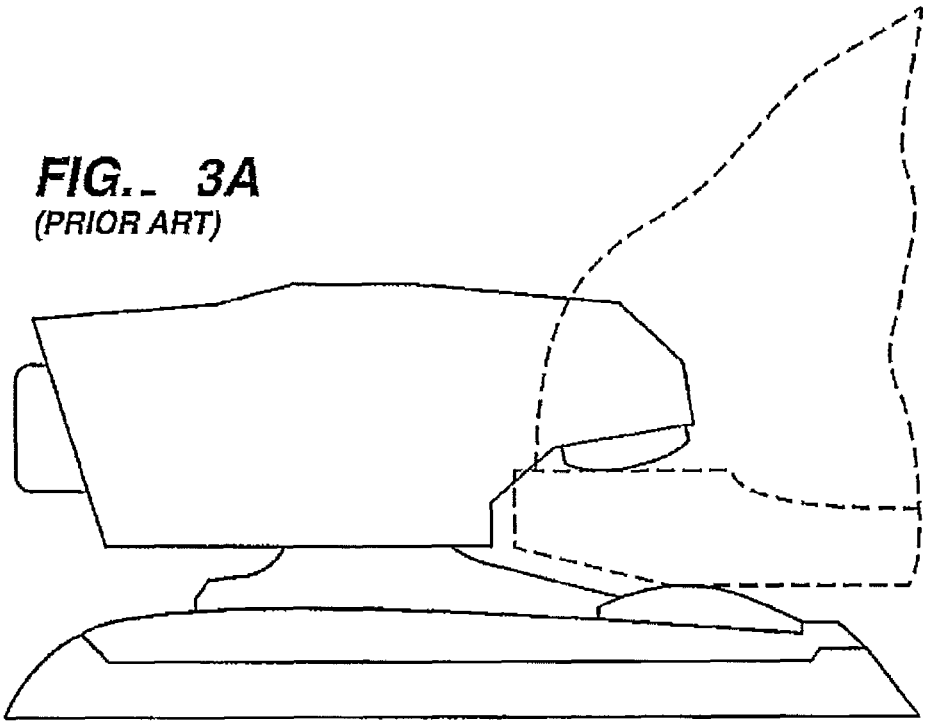
FIG. 3A (PRIOR ART)
FIGS. 3A-B and 4A-B, are examples of a cutaway of a conventional adjustable toe as depicted in FIG. 4.

FIG. 3A shows a left side profile view of a ski binding toe unit engaging and supporting the front toe portion of a ski boot 60 (in phantom). Unlike many ski binding toe units, this particular design includes what is referred to as a "height adjustable" toe housing 70 (to be described in more detail hereinafter). It also includes a toe cup or boot toe holddown 72, a housing basepost 74, a baseframe 76, an elevation or liftplate 78 (optional), and a boot support 80.

Figure 3B:
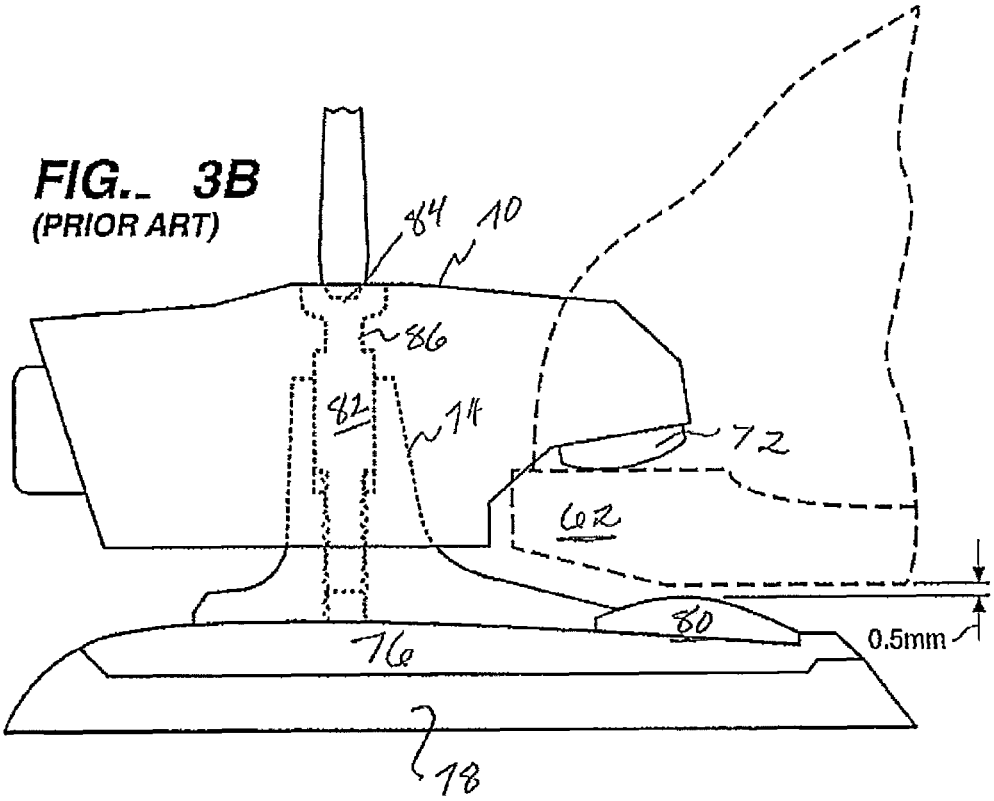
FIG. 3B (PRIOR ART)

As can be seen in FIG. 3B, basepost 74 has a portion (shown in phantom) that extends up into housing 70. Threaded down into basepost 74 is an adjustment bolt 82 (also in phantom) that includes a slotted head 84, a stepped down portion or neck 86, a larger diameter portion or shoulder 88 and a smaller diameter threaded section or threads 90. It is head 84 and neck 86 of bolt 82 that mate with and suspend housing 70 around basepost 74, via internal shaping or mating.

Continuing with FIG. 3B, by inserting a screwdriver blade into slotted head 84 (as depicted) and turning it in a counterclockwise or clockwise direction, bolt 82 can be threaded up or down within basepost 74. Since housing 70 is internally mated to and suspended from bolt 82, housing 70 will travel up or down simultaneously with bolt 82 as it is threaded up or down inside basepost 74. The purpose for this vertical adjustability of housing 70 is to allow for fine tuning of the space or gap between holddown 72 and boot support 80. This "manual gap adjustment" feature is used to accommodate variations in ski boot toe thickness due to manufacturing tolerances, as well as normal wear or thinning of the ski boot toe (caused by skiers walking and abrading their plastic boot soles on concrete and other abrasive surfaces).

The manufacturer of the toe unit in FIGS. 3A and 3B instructs technicians to adjust the gap between holddown 72 and support 80 so that 0.0 to 0.5 mm of extra gap exists beyond what's needed to accommodate the thickness of the ski boot toe. As can be seen in FIG. 3B, the thickness of the ski boot toe is that thickness between boot toeshelf 62 and the point at which bootsole 64 would make contact with support 80. In FIG. 3B, the height of toe housing 70 and holddown 72 has been adjusted to provide approximately 0.5 mm of extra gap between bootsole 64 and support 80. This 0.5 mm of gap is depicted between the small arrows to the right of support 80.

Several versions of my invention incorporate structure or parts from the type of ski binding toe unit described above in FIGS. 3A and 3B. Such designs are well known and understood by those skilled in the art. For future reference, I will refer to this type of toe unit design as one that provides "manual gap adjustment".

Figure 4A:
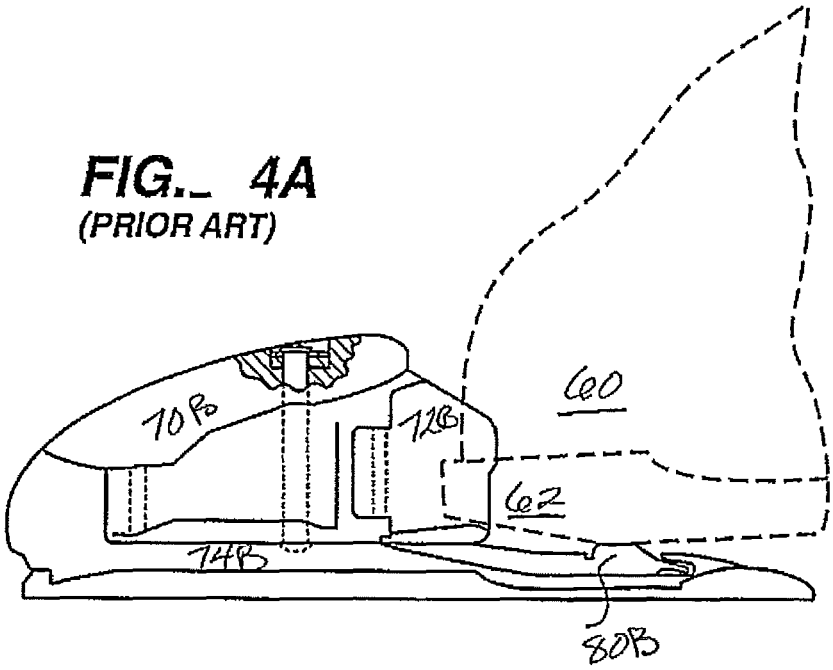
FIG. 4A (PRIOR ART)

FIG. 4A shows a left side profile view of another well-known ski binding toe unit design, engaging and supporting the front toe portion of ski boot 60 (in phantom). Somewhat similar to the toe unit previously described in FIGS. 3A and 3B, the toe unit in FIG. 4A includes a housing 70B, a toe cup or boot toe holddown 72B, a housing base 74B, a baseframe 76B, and a boot support 80B. However, unlike the toe unit from FIGS. 3A and 3B which provides "manual gap adjustment", this style of toe unit is like many other models on the market that provide an "automatic gap adjustment" function for accommodating boot toe thickness.

Figure 4B:
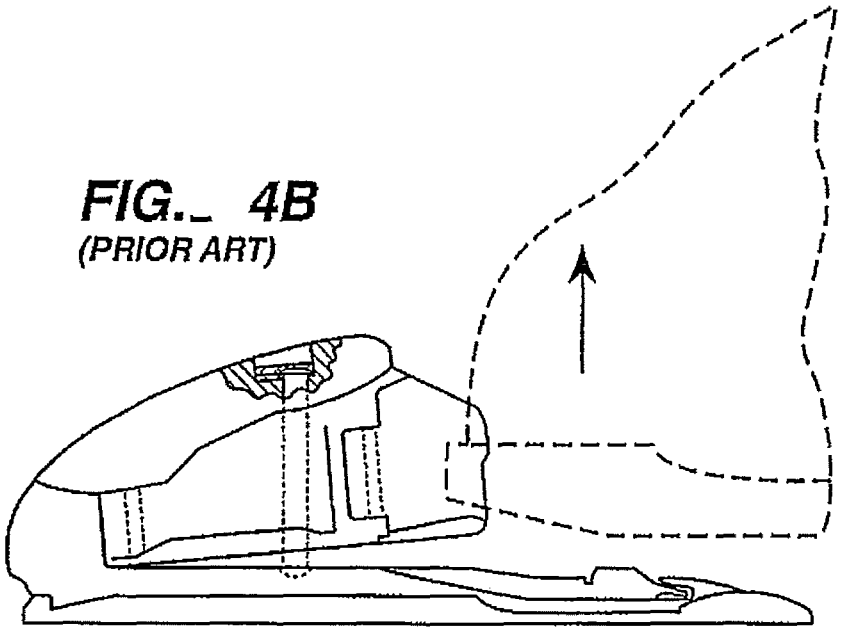
FIG. 4B (PRIOR ART)

As depicted in FIG. 4B, this is accomplished via a design whereby housing 70B and holddown 72B can hinge or pivot up and away from base 74B, baseframe 76B and support 80B. This upward hinging or pivoting is known as the toe unit's vertical elastic travel. After a predetermined amount of this vertical elastic travel occurs, holddown 72B will lose contact with ski boot toeshelf 62, releasing boot 60 from the binding system.

The first version of my invention incorporates structure or parts from the type of ski binding toe unit described above in FIGS. 3A and 3B. Such "manual gap adjustment" designs are well known and understood by those skilled in the art.

Alternate versions of my invention incorporate structure or parts from the type of ski binding toe unit described above in FIGS. 4A and 4B. Such "automatic gap adjustment" designs are also well known and understood by those skilled in the art.

Figure 5:
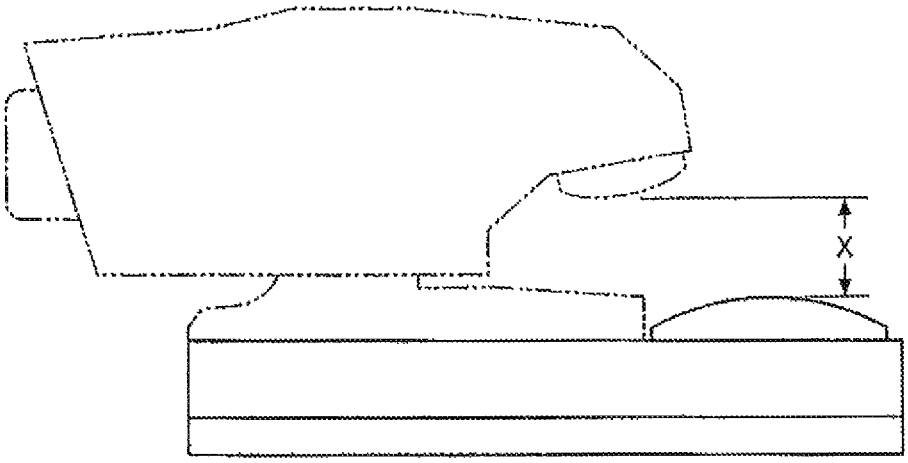
FIG. 5 shows a left side profile view of a first example embodiment.

FIG. 5 shows a left side profile view of the first version of my invention. The parts shown in phantom are incorporated from a well-known ski binding toe unit design of the type that provides "manual gap adjustment" as described in prior art FIGS. 3A and 3B. These incorporated parts include a toe housing 70, a boot toe holddown 72, and a housing basepost 74. Binding toe units that include such parts are readily available and understood by those skilled in the art.

Continuing with FIG. 5, incorporated parts 70, 72 and 74 sit on top of a gearbox which includes a top plate 116 and a bottom plate 118. Also visible is an integral height-adjustable boot support 138 which has a crowned top surface 139. Boot support 138 is shown at its lowest position, down flush against the top of gearbox plate 116. A gap "X" represents the space between boot support 138 and incorporated boot holddown 72 to accommodate the toe portion of a ski boot.

Figure 6:
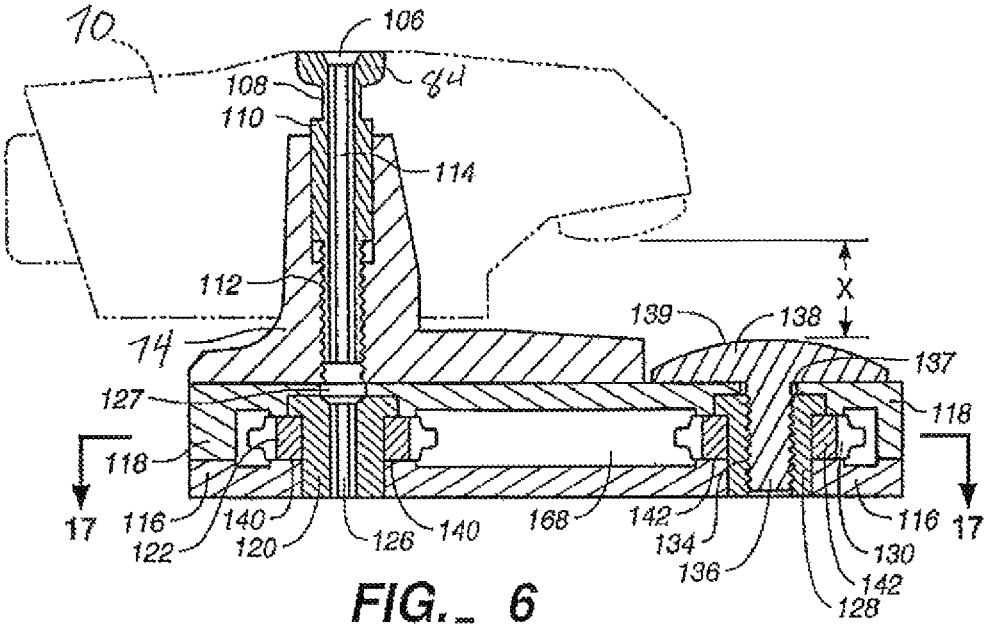
FIG. 6 is a cross sectional view (along line 16-16 of FIG. 7)

FIG. 6 is a sectional view (along lines 16-16 of FIG. 7) of incorporated basepost 74, baseframe plates 116 and 118, and boot support 138. Additionally, we can now see that a custom adjustment bolt 102 is threaded down into basepost 74 and includes a bolt head 104, a stepped down portion or neck 106, a larger diameter portion or shoulder 108, and a smaller diameter threaded section or threads 110. It is head 104 and neck 106 of bolt 102 that engages with and suspends incorporated housing 70 around basepost 74, via internal shaping or mating. Bolt 104 also includes a tool receiving hole 112 and a special extended passageway 114 (for a purpose to be described in greater detail hereinafter).

Figure 7:
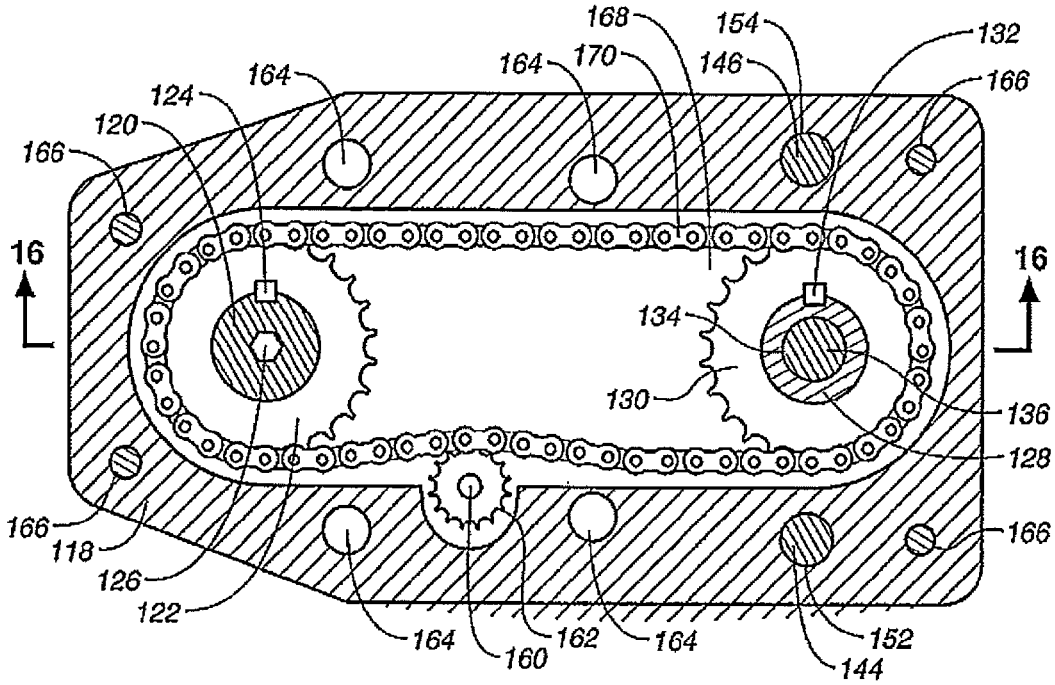
FIG. 7 depicts an example gearbox sectional view from above.

With reference to FIG. 6 and also FIG. 7 (which is a sectional view along lines 17-17 of FIG. 6), the gearbox consisting of plates 116 and 118 contain therein a drive bushing 120 on which is mounted a sprocket drive gear 122 coupled to the drive bushing via a key 124 (seen in FIG. 7). The bushing 120 has an opening 126 there through that may, if desired, have a hexagonal cross-section. As seen in FIG. 6, opening 126 is axially aligned directly under a pass hole 127 provided in top plate 116 and passageway 114 of bolt 104. As seen later in operation FIGS. 12-16, an elongated tool may be extended through passageway 114 and hole 127 to engage with opening 126 and allow controllable rotation of bushing 120 and sprocket 122.

Continuing with FIGS. 6 and 7, a further driven bushing 128 is coupled to a further driven sprocket 130 via a key 132 (seen in FIG. 7). Bushing 128 has a tapped opening 134, that threadably receives a stem 136 of support 138, through a second pass hole 137 provided in top plate 116 (visible in FIG. 6). Stem 136 has exterior threads complementary to tapped opening 134 in bushing 128. Seen in FIG. 6, bushings 120 and 128 and sprockets 122 and 130 are supported and contained by corresponding bearing surfaces 140 and 142 respectively, formed within plates 116 and 118.

With reference to FIG. 7, it is seen that sprockets 122 and 130 are constrained to rotate in tandem by an interlocking chain 170 that moves in a internal cavity 168 formed in plates 116 and 118. A small sprocket gear or idler 162 can be added with a idler shaft 160 to provide a tensioning means for chain 170. Idler shaft 160 can be pressed or threaded into a hole 161 provided in one plate, and slip fit through another corresponding hole 161 provided in the other plate (see FIGS. 10 and 11).

Also seen in FIG. 7 (and FIGS. 10 and 11) are a set of four pass holes 164. These correspond with the location of four screw-down holes already existing in incorporated basepost 74. Additionally, a set of small assembly screws 166 (FIGS. 7 and 11) and corresponding tapped and through holes in plates 116 and 118 can be provided to align and secure the gearbox together.

Figure 8:
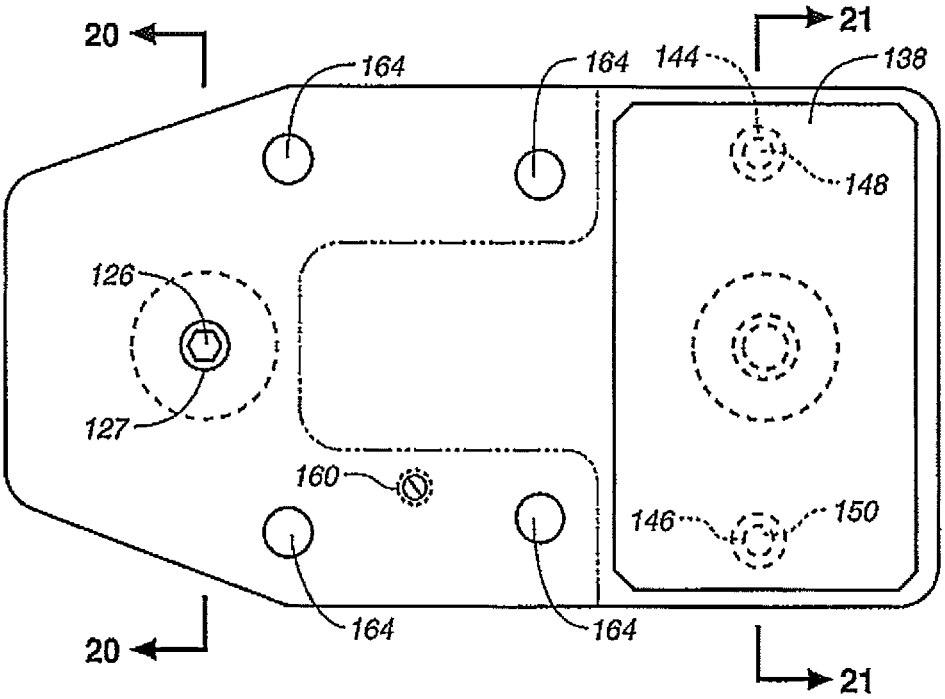
FIG. 8 illustrates another sectional view from above of FIG. 7.

FIG. 8 illustrates a sectional end view (along section lines 18-18 from FIG. 7) of incorporated basepost 74 and custom bolt 102 aligned over gearbox plates 116 and 118 (incorporated housing 70 and holddown 72 are omitted for clarity). Again we can see: extended passageway 114 axially aligned over pass hole 127 and opening 126; bushing 120 and sprocket 122, joined by key 124, bearing in and against formed surfaces 140; and cavity 168 formed in plates 116 and 118 to accommodate chain 170 and idler 162 (seen only in FIG. 7).

Figure 9:
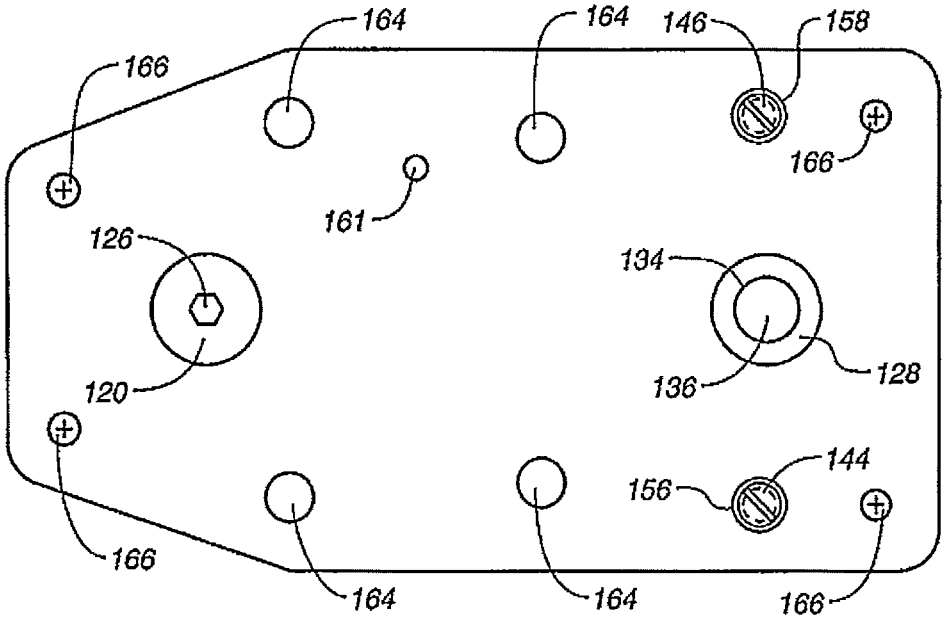
FIG. 9 depicts another sectional view from above of FIG. 7.

Seen best in FIG. 9 (a sectional end view along lines 19-19 of FIG. 7), we see bushing 128 with its tapped hole 134 threadably containing stem 136 of boot support 138; pass hole 137 in top plate 116; bushing 128 and sprocket 130, joined by key 132, bearing against formed surfaces 142 in plates 116 and 118; and cavity 168 again visible.

Continuing with FIG. 9, boot support 138 is constrained against rotation by a pair of guide pins 144 and 146, so that rotation of sprocket 130 and bushing 128 will result in up or down reciprocation of support 138. These guide pins bear within corresponding guide holes 152 and 154 in top plate 116, and guide holes 156 and 158 in bottom plate 118. These guide pins can be integrally formed in boot support 138 or be separate pieces. If separate, they can have stepped down ends that can be press fitted, or threaded and screwed up into a pair of receiving holes 148 and 150 in the underside of support 138 (as depicted).

Figure 10:
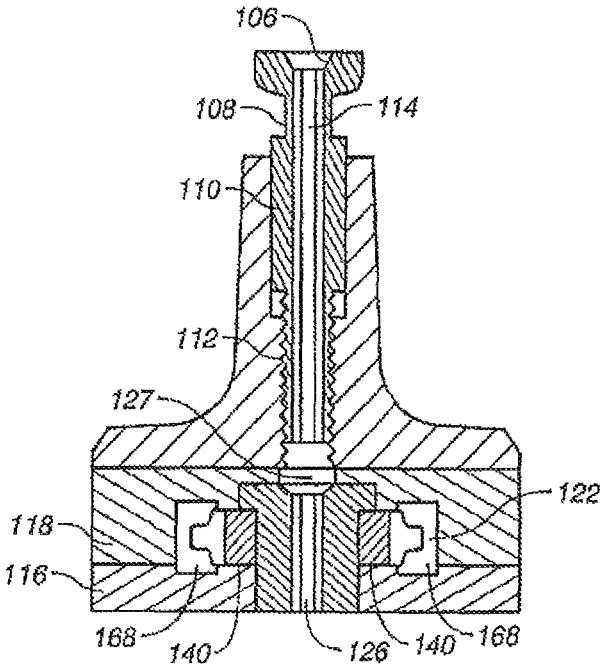
FIG. 10 is an cross-sectional view of an example gearbox top plate 116 and boot support.

Moving on, FIG. 10 is an overhead view of gearbox top plate 116 and boot support 138. With the exception of the phantom footprint outline of basepost 74, incorporated parts 70, 72 and 74 are not illustrated for clarity. Hidden lines show locations of the top flanges of bushings 120 and 128, threaded opening 134, stem 136, pass hole 137, guide pins 144 and 146 and tapped receiving holes 148 and 150. Also seen is hexagonal opening 126 visible through pass hole 127, idler shaft 160 in hole 161, and four pass holes 164.

Figure 11:
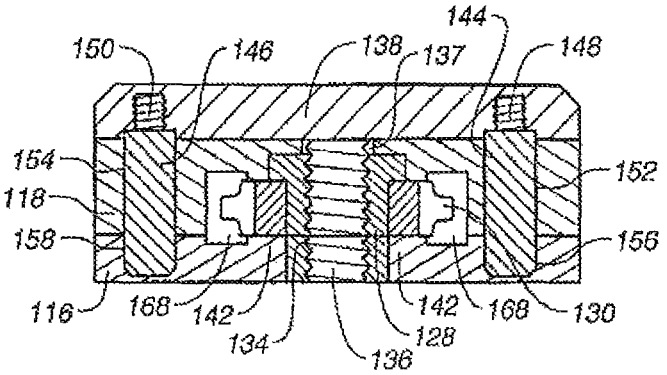
FIG. 11 is a cross section view of an example gearbox bottom plate.

FIG. 11 is a bottom view of gearbox bottom plate 118 with the following visible: bushing 120 with its hexagonal hole 126 and corresponding bearing surface 140; idler shaft 160 in corresponding hole 161; four pass holes 164; bushing 128 with its tapped hole 134 and corresponding bearing surface 142; boot support stem 136; guide pins 144 and 146 in guide holes 156 and 158; and four assembly screws 166.

The four pass holes 164 provided through gearbox plates 116 and 118 (seen in FIGS. 7, 10 and 11) are located to correspond with the existing screw hole pattern of incorporated basepost 74. This allows common ski binding screws to be used for aligning and securing basepost 74 and the gearbox (and all related parts described herein) to a ski.

OPERATION OF THE INVENTION (FIGS. 7, 9 and 12-16)

Figure 12:
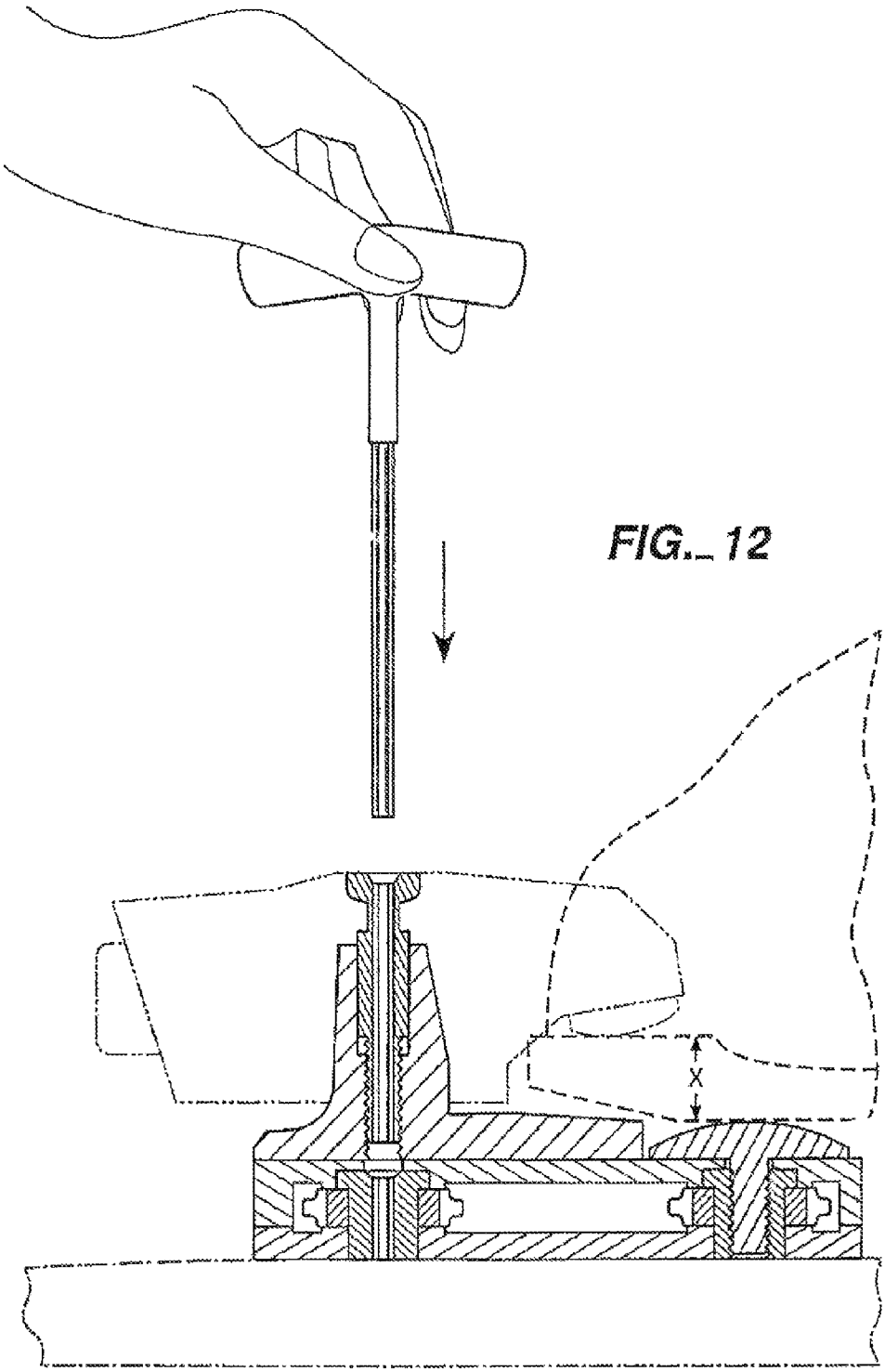

FIGS. 12A through 16A show left side sectional views of the first version of my invention mounted on ski 68 and engaging and supporting the front toe portion of ski boot 60. In FIG. 12A, an elongated tool 92 (such as a T-handle hex wrench) is positioned above opening 112 and passageway 114 of bolt 102 in preparation to enter. Boot support 138 is at its lowest position.

In FIG. 12B, tool 92 is inserted down fully through bolt 102, but not through hole 127 of plate 116 or into hexagonal opening 126 of bushing 120. In this position, rotation of tool 92 in a counterclockwise or clockwise direction will cause bolt 102 to thread up or down respectively within incorporated basepost 74 due to the right hand threading of bolt 102 and basepost 74. Since housing 70 is mated with and suspended from (head 104 and neck 106) of bolt 102, housing 70 and holddown 72 will travel up or down simultaneously with bolt 102. Therefore, by turning tool 92 when engaged only in bolt 102, adjustment to gap "X" between holddown 72 and boot support 138 can be altered to the desired fit or spacing to accommodate the toe portion of ski boot 60.

Once gap "X" has been adjusted to boot 60 as desired, tool 92 can be further extended down beyond bolt 102, passing through hole 127 of plate 116 and down into opening 126 of bushing 120. FIG. 13A shows tool 92 fully inserted to this position with boot support 138 still at its lowest position.

FIG. 13B shows a right end view of support 138 at its lowest position down flush against baseframe plates 116 and 118. Hidden lines depict threaded stem 136 and guide pins 144 and 146 extending down within baseframe plates 116 and 118.

In FIG. 14A, tool 92 is being turned in a counterclockwise direction which results in simultaneous counterclockwise rotation of bolt 102 and bushing 120. With additional reference back to description FIG. 7, since sprocket 122 is keyed to bushing 120 by key 124, sprocket 122 must rotate in tandem with bushing 120. Further, because sprocket 130 is constrained to rotate in tandem with sprocket 122 by interlocking chain 170 (that moves in cavity 168 formed in baseframe plates 116 and 118), and because sprocket 130 is keyed to bushing 128 by key 132, counterclockwise rotation of bushing 120 and sprocket 122 will cause counterclockwise rotation of sprocket 130 and bushing 128. By utilizing equally sized sprockets (as depicted), rotation of bushings 120 and 128 will occur at a 1:1 ratio.

Continuing with FIGS. 14A and 7, because of the reverse (left-hand) threading of tapped opening 134 and stem 136, counterclockwise rotation of bushing 128 will cause upward reciprocation of support 138. Conversely, clockwise rotation of bushing 128 will result in downward reciprocation of support 138. By providing the same thread pitch for stem 136 of support 138 as that used for threads 110 of bolt 102, it should now be understood that support 138 will reciprocate up and down at a 1:1 ratio to bolt 102 and suspended housing 70 and holddown 72. This is desired so as to maintain the correct space (represented by gap "X") between boot support 138 and boot holddown 72 for accommodating the toe portion of ski boot 60.

In this first version of my invention, thread pitches of one (1) millimeter are formed on stem 136 and threads 110. This provides for micro adjustment of the fore-aft ramp angle of ski boot 60, relative to the base of ski 68, in increments of approximately two-tenths (0.2) of one degree per one (1) full revolution of tool 92. (Approximation of angular change based on using a 31 cm. boot sole length.) Applicant has found that all skiers tested during experimental use could easily detect a two-tenths (0.2) of one degree change in their ski boot fore-aft ramp angle as positively or negatively affecting their balance, comfort, fatigue and overall control of the ski (during both in-store testing as well as actual skiing!). Many recreational skiers tested, especially those with tight muscles or limited flexibility, could feel adjustments as small as one-twentieth (0.05) of one degree!

FIG. 14B shows an end view of support 138 in the elevated position depicted in FIG. 14A. Guide pins 144 and 146, which are tapped and screwed up into support 138 (described previously in FIG. 9), prevent support 138 from rotating and act as bearing shafts to protect stem 136 from any stresses under load.

Figure 15B:
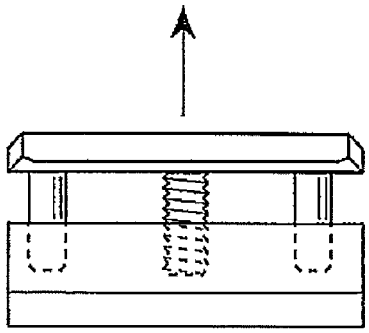
FIG. 15B depicts that a portion of shaft pins (hidden lines) (see FIG. 8) are still adequately engaged in baseframe top plate 116 to protect stem 136 (see FIG. 11)
Figure 15A:
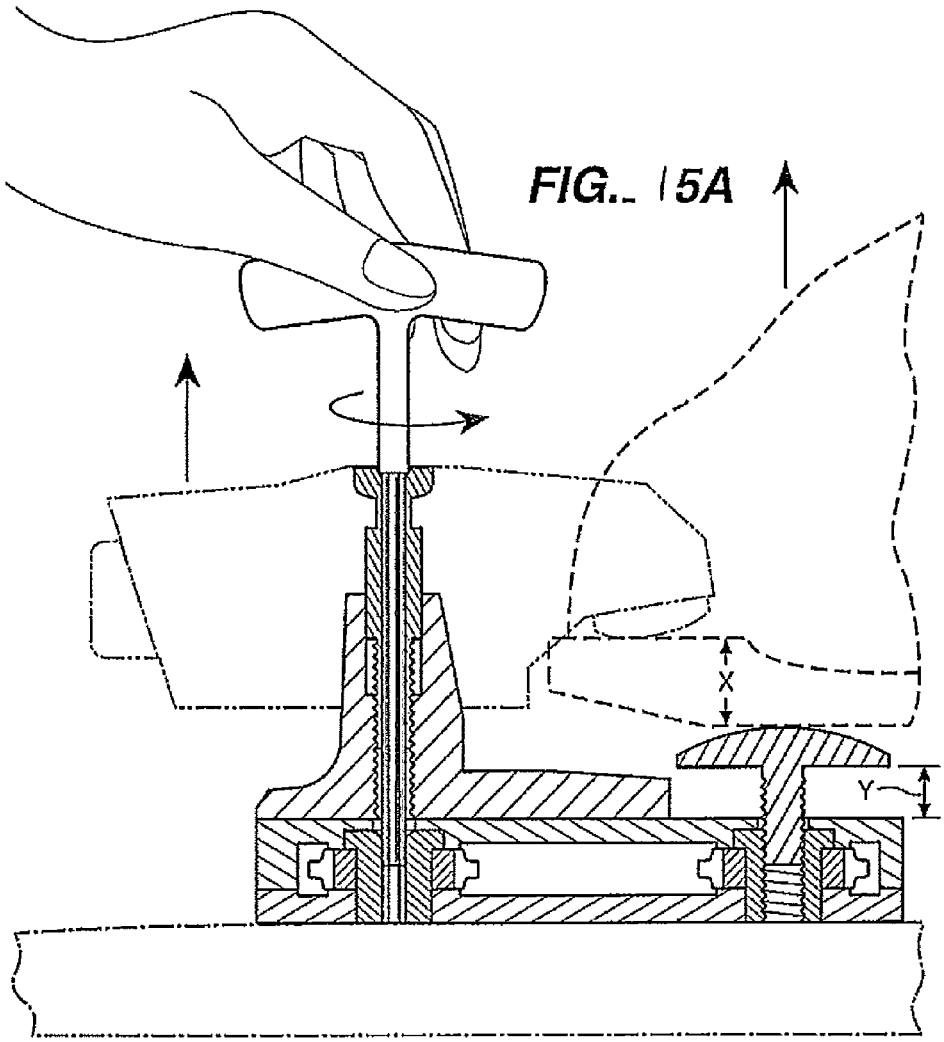
FIG. 15A depicts an adjustment tool continuing to be rotated in a counterclockwise direction.

In FIG. 15A, tool 92 continues to be rotated in a counterclockwise direction, increasing the elevation of bolt 102, housing 70, holddown 72, and boot support 138, until the skier feels that the toe of his boot 60 has been elevated excessively. The common sensation by the skier is that his center of gravity has shifted too far aft, hence, making it difficult to maintain optimum balance over his foot and the center section of the ski. It also becomes more difficult to flex in the boot and edge the ski.

The elevation of support 138, depicted by "Y" in FIG. 15A, is approximately ten (10) millimeters above its lowest possible position. Applicant has found through experimental use testing that a range of approximately ten (10) millimeters of height adjustability seems sufficient to achieve optimum fore/aft balance for different skiers in various boots. Over time, further experimental use testing and future market experience may reveal that more or less range of height adjustment may be needed.

Continuing with FIG. 15A, even at ten (10) millimeters of height adjustment, bolt 102, tool 92 and stem 136 are still adequately engaged within basepost 74, bushing 120 and 128 respectively. Likewise, in FIG. 15B a portion of shaft pins 144 and 146 (hidden lines) are still adequately engaged in baseframe top plate 116 to protect stem 136.

Figure 16B:
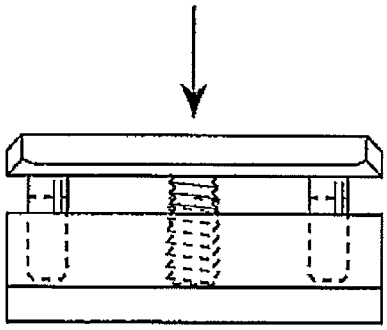
FIG. 16B shows that stem 136 and shaft pins 144 and 146 have lowered back down into baseframe plate (see FIGS. 8 and 11)
Figure 16A:
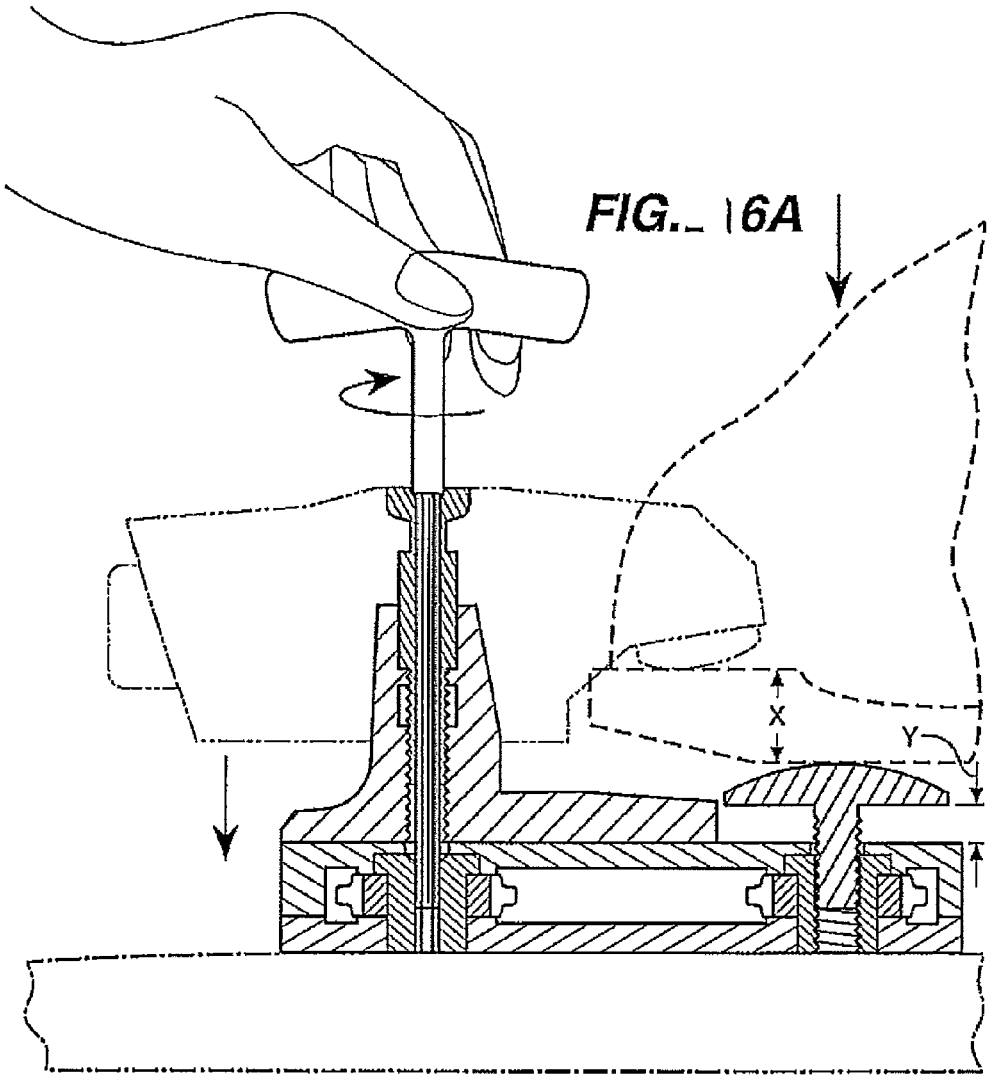
FIG. 16A depicts an adjustment tool 92 is being turned in a clockwise direction.

In FIG. 16A, tool 92 is now being rotated in a clockwise direction, lowering simultaneously bolt 102, housing 70, holddown 72, and boot support 138, until a point of height adjustment is achieved that provides the skier with a feeling of being optimally balanced fore and aft over his foot and ski. End view FIG. 16B shows that stem 136 and guides 144 and 146 have lowered back down into baseframe plate 102, as compared to FIG. 15B.

The feeling of optimal fore/aft balance is commonly described as a point of adjustment where the skier's entire foot feels the most planted or stable within the boot. In addition to this planted or stable sensation, skiers also experience improved ability to balance on one foot, flex in the ski boot, and tip the ski up on edge.

Figure 17:
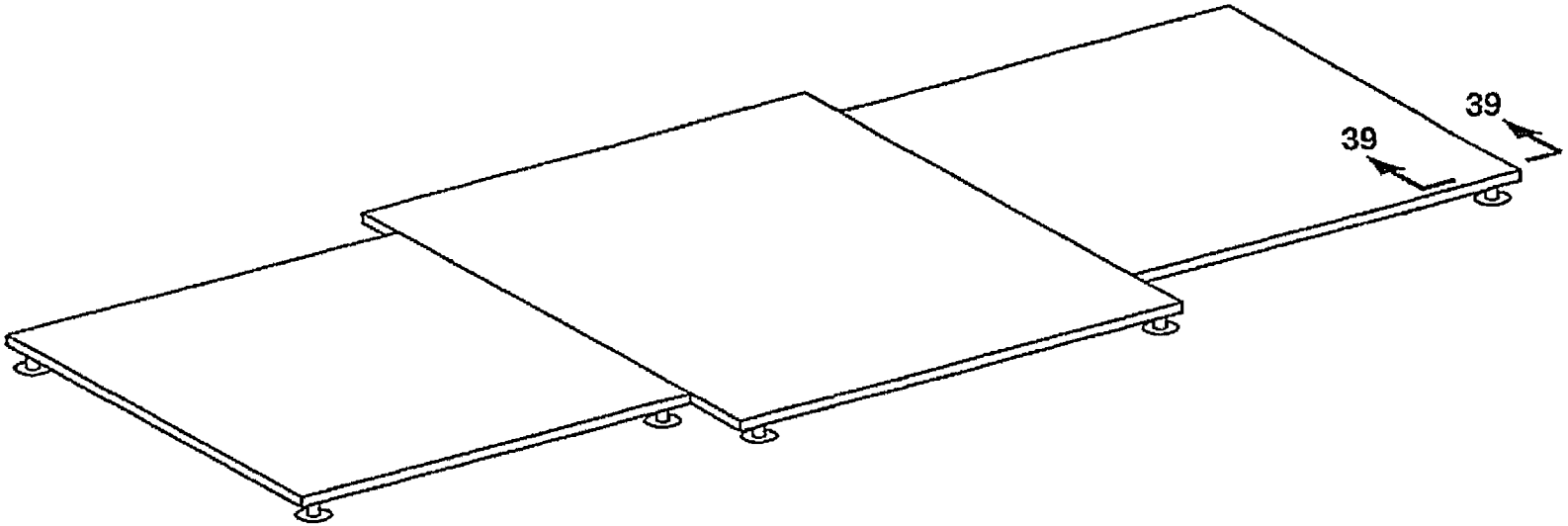
FIGS. 17 and 18 depict an in-store testing reference surface.
Figure 18:
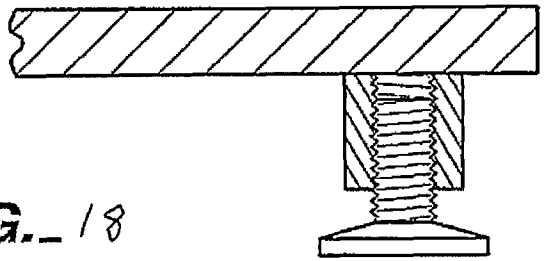

This first version of my invention, as described above and illustrated in FIGS. 5-16, is best summarized as a ski binding toe unit intended to be mounted on a customer's ski or on a test or demo ski, which can be used for both in-store testing and actual skiing. Optimally, the skier is assisted in the testing and adjustment process in-store on a reference surface (see FIGS. 17 and 18), and then can experiment with and fine tune the adjustment feature out on the hill while skiing. Adjustment tool 92 or a similar functioning tool can be removed or left inserted at will.

DESCRIPTION AND OPERATION OF ALTERNATE EMBODIMENTS

Different embodiments of a ramp angle plate (RAP) 60 are designed either to mate with a standard toe bearing surface 32, to replace a standard toe bearing surface 32, or to mate with a modified toe bearing surface 32, as described in detail later.

To better understand the operation and effectiveness of the invention, it is helpful to understand at least basic binding function. Most modern bindings include a toe unit and a heel unit that attach the boot to the ski in two separate places, and that function in different ways to provide effective retention of the boot to the ski for control, and effective release of the boot from the ski in various directions for safety, as in the case of a fall.

The toe unit captures or retains the toe portion of the boot sole for control, and provides primarily lateral release in twisting falls and sometimes vertical release in backward falls. Since twisting falls and backward falls can be quite dangerous, a lower retention force is provided in the toe unit to allow these directions of release. Furthermore, mechanical play or elasticity is purposefully designed into the toe unit. The first reason is to accommodate for allowable boot sole shape tolerances and expected wear. Another reason is to enhance release when needed by minimizing or reducing friction between the boot sole and toe unit. Due to the combined effect of the lower retention force and mechanical play or elasticity, the toe unit does not capture or hold the boot down against the ski, relative to the longitudinal running surface, as aggressively as the heel unit.

Figure 19A:
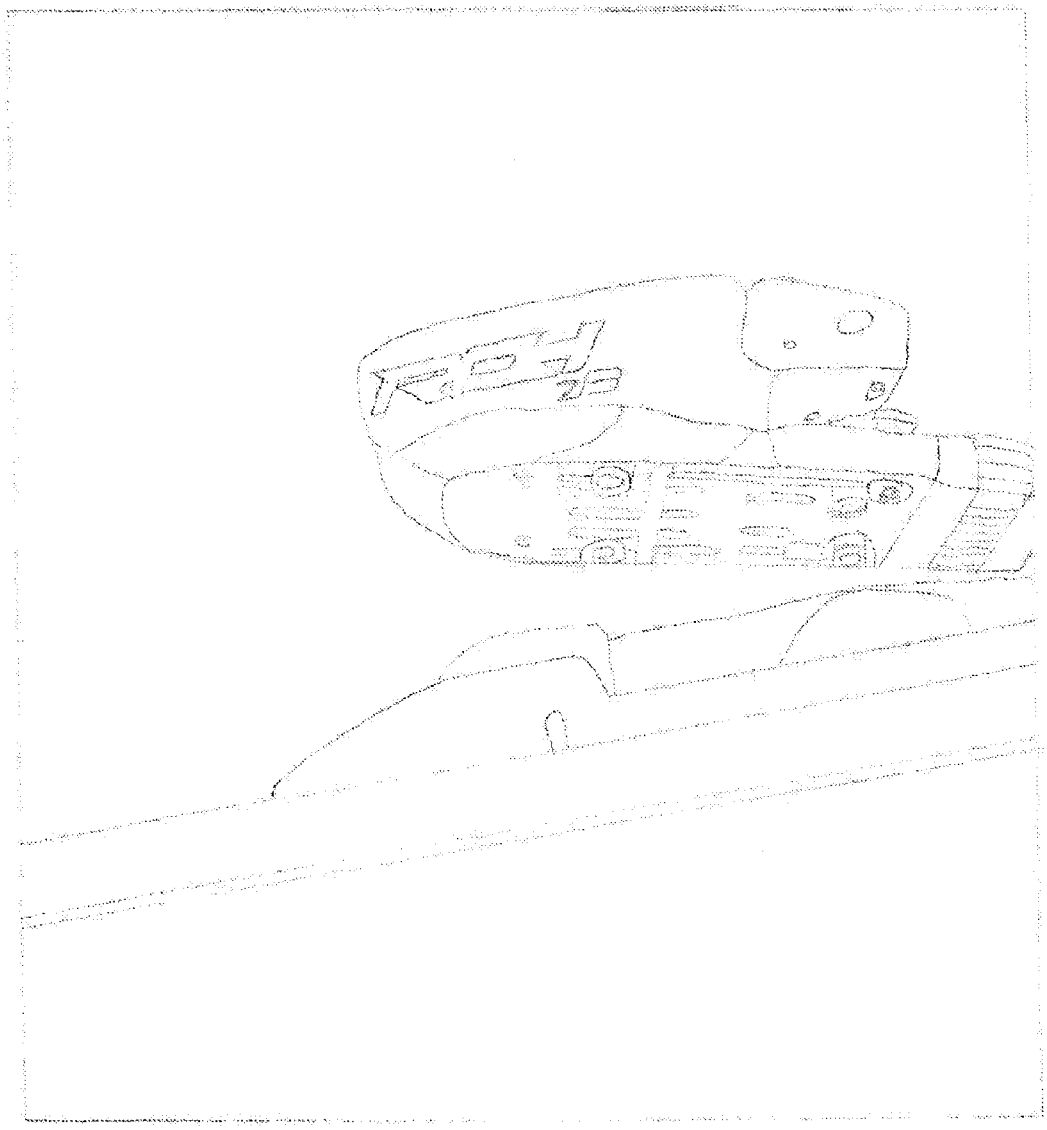
Figure 19A:
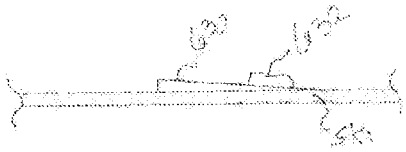
Figure 17B:
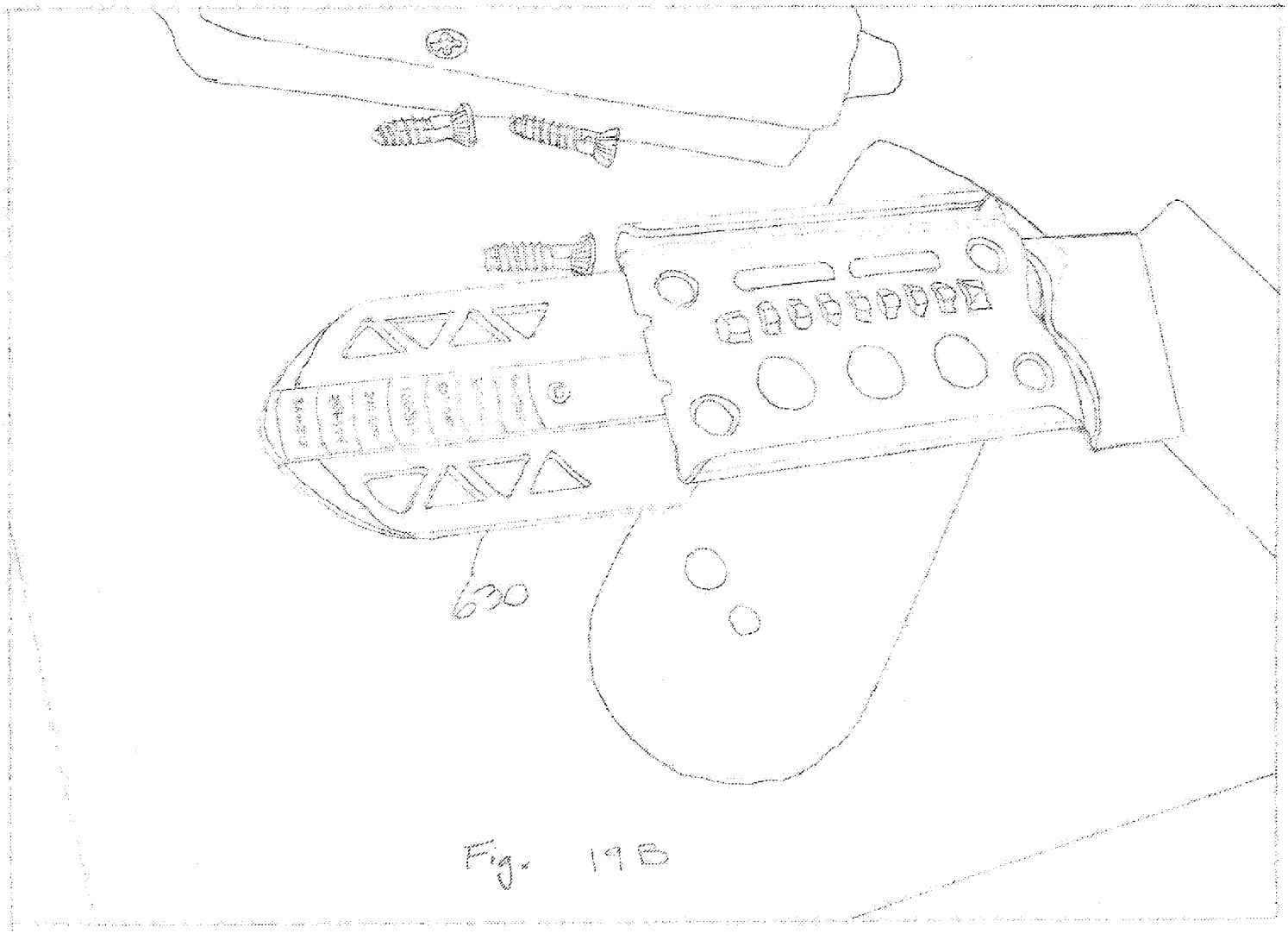

An alternate embodiment that is more simple and less costly but which does not have as wide of range of adjustment would be on where the initial ramp angle was withing two or three millimeters of the optimal desired ramp. This would be accomplished by binding selection and the use of shims under the heel unit to raise it if necessary. The fine adjustment would then be made at the toe by utilizing a wedge shaped movable piece that raises and tilts the AFD as it is moved toward the front of the ski and lowers the AFD as it is moved toward the heel of the ski. FIGS. 19A and B show a cutaway view of such an embodiment.

An alternate embodiment that only uses Teflon—like thin shim pieces would be used for only raising the toe (and reducing the ramp angle) for those toe units which have an adjustment such as shown in FIGS. 3 and 4.

CONCLUSION, RAMIFICATIONS, AND SCOPE

Accordingly, various embodiments of an apparatus and method for balancing a skier have now been described which are compatible with existing binding systems, that can be used to modify existing binding systems, or can be manufactured into existing binding systems by binding manufacturers. All of these embodiments provide a fast, accurate, reversible, safe and inexpensive means to alter a skier's ramp angle, and can be easily applied by any ski shop personnel or by the skier himself.

While the above description contains much specificity, this should not be construed as limitations on the scope of the invention but as merely providing illustrations of some of the presently preferred embodiments of the invention. Many alternatives and substitutions will now be apparent to persons of skill in the art.

Thus the scope of the invention should be determined by the following appended claims and their legal equivalents, not by the examples given.

What is claimed is:

1. An adjustable toe portion of a ski binding that creates a ramp angle at which a ski boot supports a skier's foot and lower leg, relative to the longitudinal running surface or bottom plane of an attached ski, where the ski boot is attached to the ski by a ski binding having a toe portion including a toe bearing surface on which the toe of the ski boot rests and with the toe portion having a toe holdown part for mechanically engaging an upper surface of toe of the ski boot, the toe portion of the ski binding comprising:

a gap creating mechanism configured to adjust spacing between the upper surface of the toe of the ski boot and the toe holdown to a gap value; and a ramp angle creating mechanism configured to raise the toe bearing surface of toe portion of the ski binding without changing the gap value so that a selected ramp angle relative to the bottom plane of the ski is formed when the toe of an attached ski boot rests on the toe bearing surface while maintaining the gap value.

2. The apparatus of claim 1 where the gap value is in the range of about 0.0 to 0.5 mm beyond what is need to accommodate the toe of the ski boot.

* * * * *